US006513498B1

(12) United States Patent
Frank

(10) Patent No.: US 6,513,498 B1
(45) Date of Patent: Feb. 4, 2003

(54) PRESTRESSED WELDED CONNECTION STUB FOR A FUEL INJECTION SYSTEM FOR INTERNAL COMBUSTION ENGINES

(75) Inventor: Kurt Frank, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,255

(22) PCT Filed: May 19, 2000

(86) PCT No.: PCT/DE00/01620

§ 371 (c)(1),
(2), (4) Date: Apr. 26, 2001

(87) PCT Pub. No.: WO01/06116

PCT Pub. Date: Jan. 25, 2001

(30) Foreign Application Priority Data

Jul. 15, 1999 (DE) ..... 199 33 254

(51) Int. Cl.[7] ..... F02M 37/04
(52) U.S. Cl. ..... 123/456; 123/468; 285/24
(58) Field of Search ..... 123/468–9, 470, 123/456; 285/24

(56) References Cited

U.S. PATENT DOCUMENTS

| | | | | |
|---|---|---|---|---|
| 4,979,295 A | | 12/1990 | Stagni et al. | |
| 5,072,710 A | * | 12/1991 | Washizu | 123/470 |
| 5,172,939 A | * | 12/1992 | Hashimoto | 285/24 |
| 5,667,255 A | * | 9/1997 | Kato | 285/133.4 |
| 5,775,302 A | | 7/1998 | Guido et al. | |

FOREIGN PATENT DOCUMENTS

| | | |
|---|---|---|
| DE | 1 937 444 | 2/1971 |
| DE | 93 02 824.5 | 5/1993 |
| DE | 94 03 470.2 | 7/1995 |
| EP | 0 751 336 A1 | 1/1997 |
| EP | 0 866 221 A 1 | 9/1998 |
| FR | 2 762 050 | 10/1998 |

* cited by examiner

*Primary Examiner*—Thomas N. Moulis
(74) *Attorney, Agent, or Firm*—Ronald E. Greigg

(57) ABSTRACT

A connection stub and a housing, in particular a high-pressure fuel reservoir, for fuel injection system for internal combustion engines with a welded connection stub, are proposed, in which sealing faces between the housing and the connection stub are provided, spatially separately from the weld seam.

23 Claims, 3 Drawing Sheets

PRESTRESSED WELDED CONNECTION STUB FOR A FUEL INJECTION SYSTEM FOR INTERNAL COMBUSTION ENGINES

CROSS-REFERENCE TO RELATED APPLICATIONS

This application is a 35 USC 371 application of PCT/DE 00/01620 filed on May 19, 2000.

BACKGROUND OF THE INVENTION

1. Field of the Invention

The invention relates to a connection stub to a housing, in particular a high-pressure fuel reservoir with a connection stub welded onto it, as generically defined by the preamble to claim 4, for a fuel injection system for internal combustion engines.

2. Description of the Invention

The various component groups of a fuel injection system, such as the high-pressure fuel pump, the high-pressure fuel reservoir and injection nozzles, typically communicate with one another through hydraulic lines. Sealing off these connections is often done with the aid of clamping nuts slipped over the hydraulic line, which are screwed to a connection stub that communicates in a fluid-tight fashion with the housing of the applicable component group. The high-pressure fuel reservoir in particular has many such connection stubs, which by way of example allow fuel delivery and fuel outflow into and out of the reservoir.

Connection stubs that are welded to the housing are known. A disadvantage of the known welded constructions is that the weld seam has two functions. First, it must establish the connection between the housing and the connection stub and transmit all forces. Especially in modern fuel injection systems, the high, swelling pressures lead to high, swelling tensile stresses in the weld seam. Second, the weld seam must perform a sealing function, which makes additional demands of the weld seam.

A further disadvantage of the known welded constructions is that in the welding operation, splatters or mounds of welding material can enter the high-pressure region of the line or of the fuel reservoir, which can cause functional disturbances of the fuel injection system.

SUMMARY OF THE INVENTION

The object of the present invention is to furnish a connection stub and a housing and a connection stub communicating with it that seal off the high-pressure region of the housing and of the connection stub reliably from the environment, and in which the high-pressure region is reliably protected against particles that can occur when the two components are joined to one another.

According to the invention, this object is attained by a connection stub for a fuel injection system for internal combustion engines with a through bore extending in the direction of the longitudinal axis and with a first end, on which a clamping element disposed concentrically with the through bore is provided, which clamping element has a through bore and a cylindrical sealing face.

In the connection stub of the invention, the clamping element, with its cylindrical sealing face, in conjunction with a suitably designed housing, takes on the function of sealing off the fuel, located in the through bore, from the environment. As a result of the spatial separation of the functions of "holding" and "sealing" of the connection stub, both the sealing face and the connection of the connection stub and the housing can be designed optimally.

The sealing face also prevents welding splatters or chips that occur when the connection stub and the housing are joined together from reaching the high-pressure region of the connection stub or the housing.

One embodiment provides that the connection stub and the clamping element are embodied integrally; this minimizes the number of components.

In another feature of the invention, the connection stub and the clamping element are separate components, so that both components can be optimized separately in terms of shaping, material and production methods.

In a version of the invention, the sealing face has the shape of an external cylindrical surface, so that the operating pressure of the fuel expands the sealing face toward the outside, thus increasing the pressure per unit of surface area between the sealing face of the connection stub and of the housing.

Another variant provides that at least one groove for receiving a sealing ring is present in the clamping element.

The object stated at the outset is also attained by a housing, in particular a high-pressure fuel reservoir, for a fuel injection system for internal combustion engines, having a connection stub, communicating in fluid-tight fashion with the housing and having a through bore, wherein the housing interior and the through bore communicate hydraulically through a bore in the housing, wherein the means for connecting the housing and the connection stub and the means for sealing the connection of the housing and the connection stub are spatially separated.

Because of the spatial separation of the functions of "holding" and "sealing", these functions can each be designed optimally in terms of construction and production. Furthermore—in contrast to the prior art, in which a weld seam also takes on the function of sealing off from the environment—the notching effect that the operating pressure causes when the fuel reaches the weld seam is dispensed with. In addition, the spatial separation of the functions of "holding" and "sealing" virtually precludes damage to the sealing face when the connection stub and housing are joined together.

A feature of the invention provides that on a first end of the connection stub, concentrically with the through bore, a cylindrical clamping element is disposed, and the clamping element has a through and, that the bore, on its end toward the connection stub, has a counterbore, which with the clamping element forms a press fit.

The press fit seals off the through bore of the connection stub and the bore of the housing from the environment and thus forms the sealing face. Because of the pressure per unit of surface area between the clamping element and the counterbore of the housing, a good sealing action is attained.

In another variant, it is provided that a countersunk feature is disposed on a first end of the connection stub, concentrically with the through bore; that the bore of the housing, on its end toward the connection stub, has counterbore; and that between the connection stub and the housing, there is a cylindrical clamping element, which with the countersunk feature of the connection stub and the counterbore of the housing forms press fits, so that the connection stub, clamping element and housing can each be made of materials optimally adapted to given requirements, thus improving the operating safety.

In another embodiment of the invention, the clamping element has the form of an external cylindrical surface, so that the operating pressure of the fuel expands the sealing face of the clamping element in the outward direction. As a result, the pressure per unit of surface area between the sealing face of the connection stub and the sealing face of the indentation of the housing is increased, which additionally enhances the tightness of the connection.

In a further feature of the invention, at least one groove for receiving a sealing ring is present in the clamping element, so that the fluid is further enhanced by the sealing ring.

In a modification of the invention, grooves, each for receiving at least one sealing ring, are present in the indentation of the housing and in the countersunk feature of the connection stub, so that the clamping element can be especially small in size, since the sealing rings take over part of the function of "sealing", and the clamping element is not weakened by grooves for receiving a sealing ring.

In an embodiment according to the invention, the connection stub is joined to the housing by welding. This housing has the advantages of the known welded constructions, such as simple, economical production, without having their disadvantages. In addition, because of the prestressing of the clamping element, once the welding has been done, prestressing permanently exists between the sealing faces of the connection stub and of the housing. The spatial separation of the sealing face and the weld seam prevents welding splatters from penetrating the high-pressure region of the housing or the connection stub. Finally, the notch effect on the weld seam, which effect may be engendered by the fuel that is at operating pressure, is omitted.

This is true above all whenever the effective cross-sectional area of the sealing face of the clamping element, which area is acted upon by the operating pressure of the fuel, is smaller than the area enclosed by the weld seam.

BRIEF DESCRIPTION OF THE DRAWINGS

Further advantages and advantageous features of the invention can be learned from the ensuing description, take with the drawing, in which.

DESCRIPTION OF THE PROPOSED EMBODIMENTS

Figure 1:
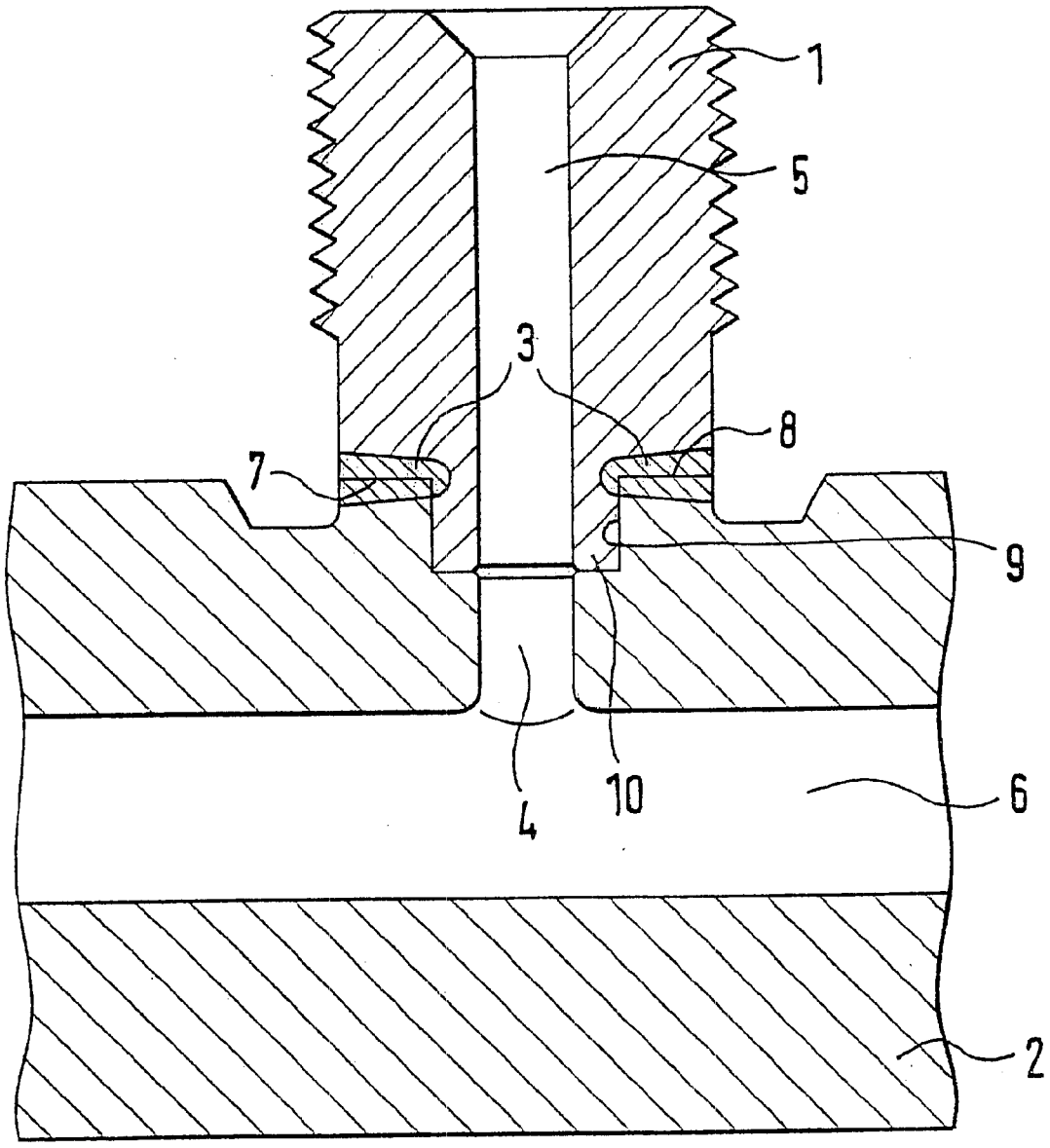
FIG. 1, is a sectional view of a first embodiment of a connection stub according to the invention and of a high-pressure fuel reservoir.

In FIG. 1, a first embodiment of a connection stub 1 of the invention is shown. The connection stub 1 is joined to a high-pressure fuel reservoir 2 by an encompassing weld seam 3. The high-pressure fuel reservoir 2 has a bore 4, which communicates with a through bore 5 of the connection stub 1 and with the interior 6 of the high-pressure fuel reservoir 2.

On the end of the connection stub 1 toward the high-pressure fuel reservoir 2, the connection stub has a collar 7. This collar, when it is seated on a corresponding annular face 8 of the high-pressure fuel reservoir 2, acts as a stop in the direction of the longitudinal axis of the connection stub 1. This makes it possible to define the position of the connection stub 1 in the axial direction with respect to the high-pressure fuel reservoir 2 upon welding.

A clamping element 10 of the connection stub 1 protrudes into a cylindrical counterbore 9 of the high-pressure fuel reservoir 2. The clamping element 10, together with the counterbore 9 of the high-pressure fuel reservoir 2, forms a press fit and thus seals off the connection of the high-pressure fuel reservoir 2 and the connection stub 1 from the environment. The sealing face is thus formed by the press fit between the connection stub 1 and the high-pressure fuel reservoir 2.

As the operating pressure of the fuel, not shown here, in the bore 4 and the through bore 5 increases, the contact force between the clamping element 10 and the counterbore 9 of the high-pressure fuel reservoir 2 increases, and thus the tightness of the connection increases as well.

A line, not shown, is typically secured to the end of the connection stub 1 remote from the high-pressure fuel reservoir 2, by means of a union nut, also not shown.

Figure 2:
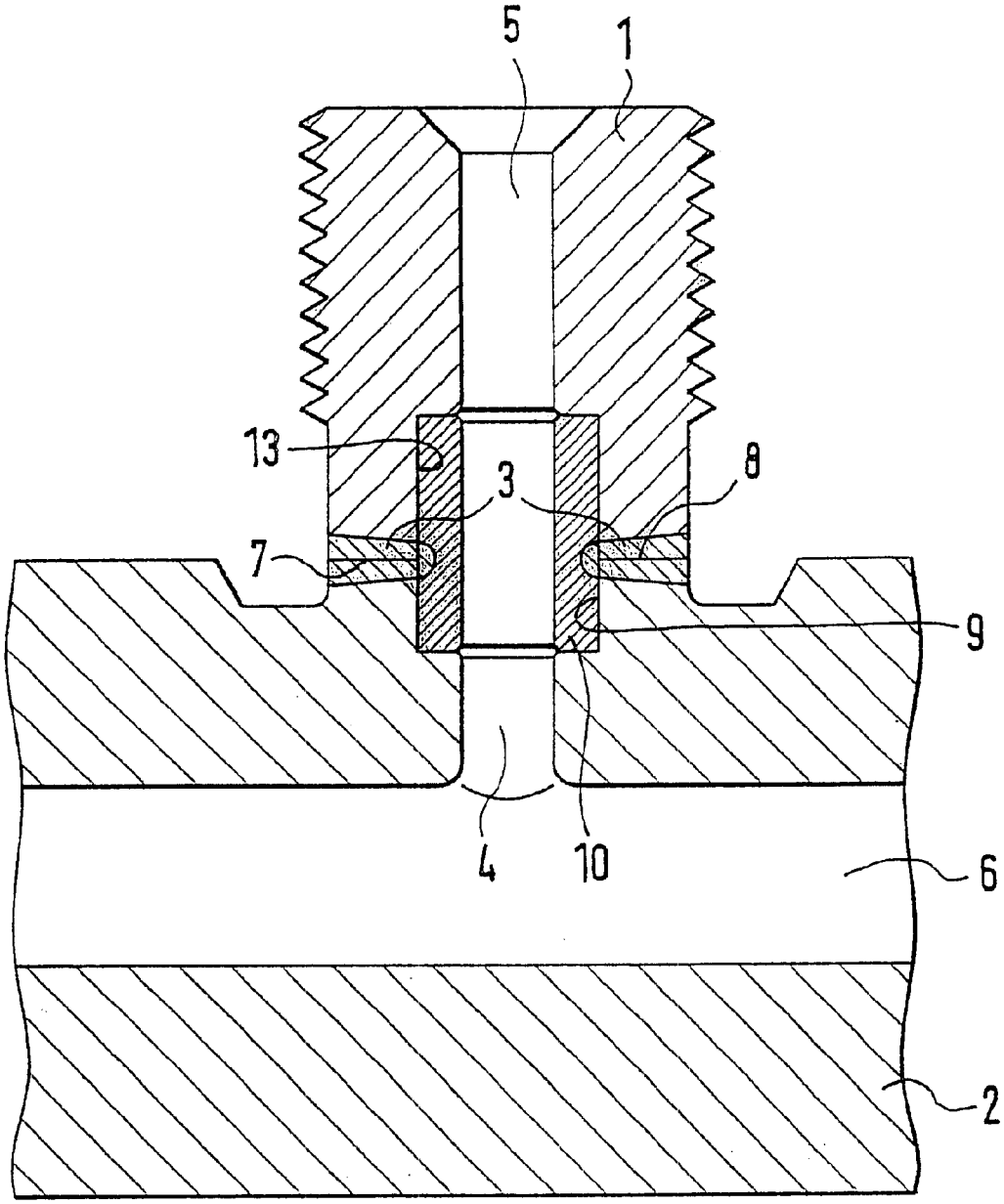
FIG. 2, is a view similar to FIG. 1 showing a second embodiment of a connection stub according to the invention and of a high-pressure fuel reservoir.

FIG. 2 shows a second embodiment of a connection stub 1 of the invention. The reference numerals used correspond to those of FIG. 1.

The connection stub 1 has a cylindrical countersunk feature 13, into which the clamping element 10, embodied as a separate component, protrudes. The clamping element 10 together with the counterbore 9 of the high-pressure fuel reservoir 2 and the countersunk feature 13 form press fits. Because the clamping element 10 is embodied as a separate component, it can be optimized in terms of material and production methods independently of the connection stub 1 and the high-pressure fuel reservoir 2. The diameter of the countersunk feature 13 and of the counterbore 9 need not, as shown here, be the same. Also in this embodiment, the operating pressure of the fuel, not shown here, in the bore 4 and the through bore 5 increases the tightness of the connection of the high-pressure fuel reservoir 2 and the connection stub 1.

Figure 3:
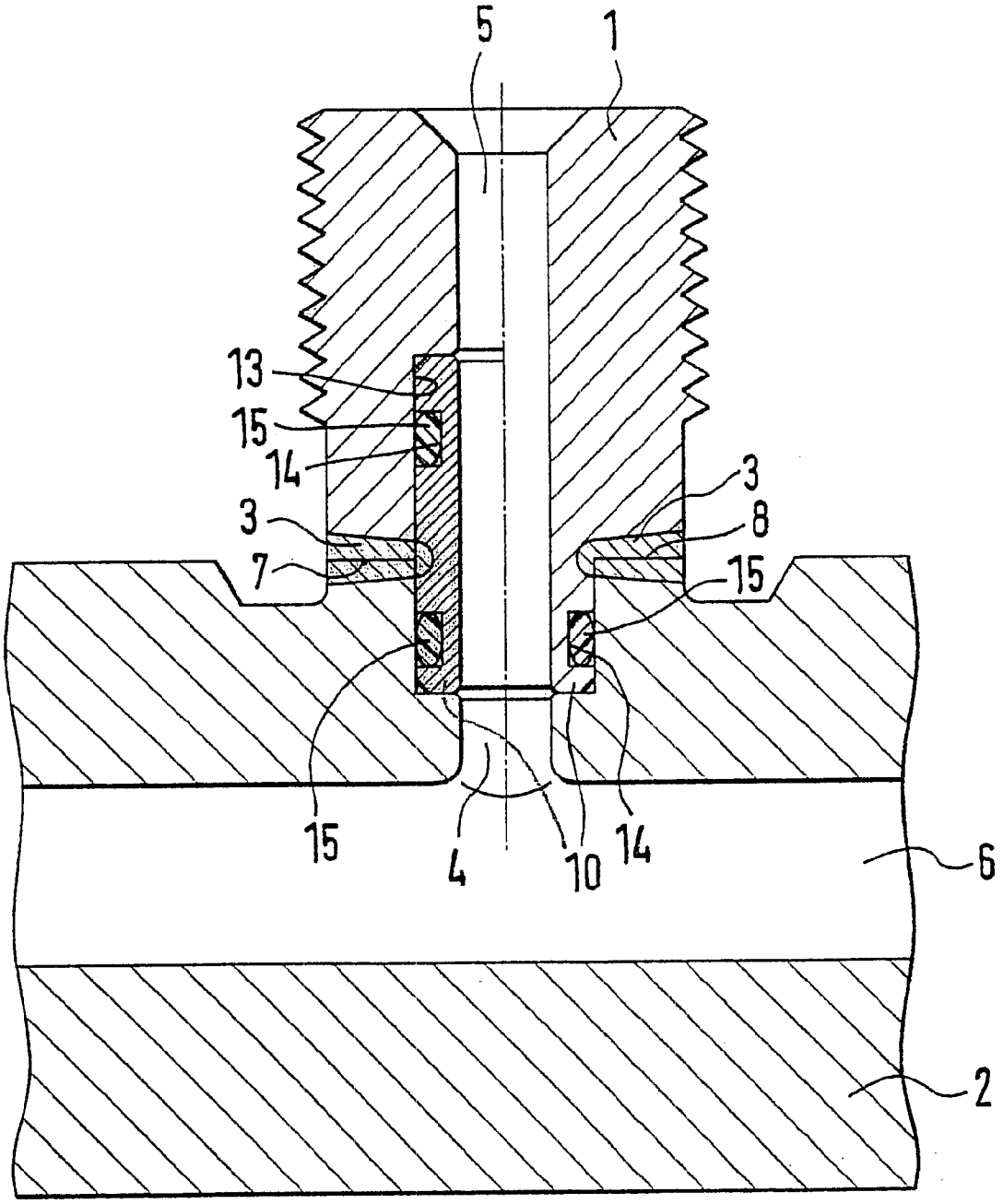
FIG. 3, is a view similar to FIGS. 1 and 2 showing a third embodiment of a connection stub according to the invention and of a high-pressure fuel reservoir, with sealing rings.

On the right-hand side of FIG. 3, an embodiment as in FIG. 1 is shown, with the difference that the clamping element 10 has a groove 14, in which there is a sealing ring 15.

On the left-hand side of FIG. 3, an embodiment with a separate clamping element 10 as in FIG. 2 is shown, in which the clamping element 10 has two grooves 14 and two sealing rings 15. One of the sealing rings 15 that are located in the grooves 14 seals off the clamping element 10 from the counterbore 9 in the high-pressure fuel reservoir 2, and the other sealing ring 15 seals the clamping element 10 off from the countersunk feature 13 of the connection stub 1.

By the use of sealing rings, the fluid of the connection of the high-pressure fuel reservoir 2 and the connection stub 1 can be increased further. The grooves 14 can also be made in the countersunk feature 13 and the counterbore 9.

The foregoing relates to preferred exemplary embodiments of the invention, it being understood that other variants and embodiments thereof are possible within the spirit and scope of the invention, the latter being defined by the appended claims.

What is claimed is:

1. A connection stub (1) which is connected to a high-pressure fuel reservoir (2) in a fuel injection system for internal combustion engines, said connection stub (1) having a first end, a longitudinal axis, and a through bore (5) extending in the direction of the longitudinal axis, the connection stub comprising a clamping element (10) and a welding collar (7) on the first end, said clamping element (10) being disposed concentrically with the through bore (5), the through bore extending through said clamping element in the direction of the longitudinal axis, said clamping element (10) having a cylindrical sealing face, said high-pressure fuel reservoir (2) having an annular face (8) to which said welding collar (7) is brought into face to face contact so as to accept a weld joint there between.

2. The connection stub (1) of claim 1, wherein the connection stub (1) and the clamping element (10) are embodied integrally.

3. The connection stub (1) of claim 1, wherein the connection stub (1) and the clamping element (10) are embodied as separate components.

4. The connection stub (1) of claim 1, wherein the sealing face has the shape of an external cylindrical surface.

5. The connection stub (1) of claim 1, wherein at least one groove (14) for receiving a sealing ring (15) is present in the clamping element (10).

6. In a high-pressure fuel reservoir housing (2) for a fuel injection system for internal combustion engines having a connection stub (1) communicating in fluid-tight fashion with the housing and having a through bore (5), wherein the housing interior and the through bore (5) communicate hydraulically through a bore (4) in the housing, the improvement wherein the means (3) for connecting the housing and the connection stub (1) and the means (10, 9) for sealing the connection of the housing and the connection stub (1) are disposed spatially separately.

7. The housing of claim 6, wherein on a first end of the connection stub (1), concentrically with the through bore (5), a cylindrical clamping element (10) is disposed, and the clamping element has a through bore; that the bore (4), on its end toward the connection stub (1), has a counterbore (9), which with the clamping element (10) forms a press fit.

8. The housing of claim 6, wherein a countersunk feature (13) is disposed on a first end of the connection stub (1), concentrically with the through bore (5); that the bore (4) of the housing, on its end toward the connection stub (1), has a counterbore (9); and that between the connection stub (1) and the housing, there is a cylindrical clamping element (10), which with the countersunk feature (13) of the connection stub and the counterbore (9) of the housing forms press fits; and that the clamping element (10) has a through bore.

9. The housing of claim 6, wherein the clamping element (10) has the form of an external cylindrical surface.

10. The housing of claim 6 further comprising at least one sealing ring groove (14) formed in said clamping element (10), and a sealing ring (15) and a sealing ring disposed in each side at least on sealing ring groove.

11. The housing of claim 6, wherein the means (9, 10) for sealing include grooves (14) for receiving at least one sealing ring (15), which at least one sealing ring cooperates with an indentation (9) of the housing, or with a countersunk feature (13) of the connection stub (1), or with both.

12. The housing of claim 6, wherein the connection stub (1) is joined to the housing by welding.

13. The connection stub (1) of claim 2, wherein the sealing face has the shape of an external cylindrical surface.

14. The connection stub (1) of claim 4, wherein at least one groove (14) for receiving a sealing ring (15) is present in the clamping element (10).

15. The connection stub (1) of claim 4, wherein at least one groove (14) for receiving a sealing ring (15) is present in the clamping element (10).

16. The housing of claim 7, wherein the clamping element (10) has the form of an external cylindrical surface.

17. The housing of claim 8, wherein the clamping element (10) has the form of an external cylindrical surface.

18. The housing of claim 7 further comprising at least one sealing ring groove (14) formed in said clamping element (10), and a sealing ring (15) is disposed in said at least one sealing ring groove.

19. The housing of claim 8 further comprising at least one sealing ring groove (14) formed in said clamping element (10), and a sealing ring (15) is disposed in each said at least one sealing ring groove.

20. The housing of claim 9 further comprising at least one sealing ring groove (14) formed in the external surface of said clamping element (10), and a sealing ring (15) is disposed in each said at least one sealing ring groove.

21. The connection stub (1) of claim 1, wherein the welding collar (7) and the annular face (8) are designed so as to mate with each other at a level which is substantially the same as an outside surface of the fuel reservoir (2).

22. The connection stub (1) of claim 1, wherein the fuel reservoir has a cylindrical indentation (9), and the sealing face is press fit within the cylindrical indentation.

23. The housing of claim 6, wherein the means for connecting the housing and the connection stub are designed as surfaces which mate with each other at a level which is substantially the same as an outside surface of the reservoir housing (2).

* * * * *